US006256957B1

(12) United States Patent
Kelly

(10) Patent No.: US 6,256,957 B1
(45) Date of Patent: Jul. 10, 2001

(54) SCRIM REINFORCED LIGHTWEIGHT CONCRETE ROOF SYSTEM

(76) Inventor: Thomas L. Kelly, 31 Sands St., Waterbury, CT (US) 06710

( * ) Notice: Subject to any disclaimer, the term of this patent is extended or adjusted under 35 U.S.C. 154(b) by 0 days.

(21) Appl. No.: 09/131,614

(22) Filed: Aug. 10, 1998

(51) Int. Cl.[7] ..... E04B 7/00

(52) U.S. Cl. ..... 52/413; 52/411; 52/783.1; 52/309.3; 52/309.12; 52/408

(58) Field of Search ..... 52/309.3, 309.7, 52/309.8, 309.12, 309.13, 309.14, 309.15, 309.16, 783.1, 783.19, 408, 410, 411, 413, 199

(56) References Cited

U.S. PATENT DOCUMENTS 3,260,023 * 7/1966 Nagin ..... 52/181
3,534,463 * 10/1970 Molin et al. ..... 228/185
4,306,395 * 12/1981 Carpenter ..... 8/188
4,334,394 * 6/1982 Mader ..... 52/309.12
4,382,435 * 5/1983 Brill-Edwards ..... 126/622
4,441,295 * 4/1984 Kelly ..... 52/408
4,578,301 * 3/1986 Currie et al. ..... 428/109
4,625,472 * 12/1986 Busick ..... 52/81.4
4,658,554 * 4/1987 Riley et al. ..... 52/309.8
4,677,800 * 7/1987 Roodvoets ..... 52/309.12
4,707,961 * 11/1987 Nunley et al. ..... 52/408
4,712,349 * 12/1987 Riley et al. ..... 52/408
4,736,561 * 4/1988 Lehr et al. ..... 52/410
4,747,247 * 5/1988 Petersen, Jr. et al. ..... 52/408
4,819,395 * 4/1989 Sugita et al. ..... 52/309.16
4,996,812 * 3/1991 Venable ..... 52/408
5,067,298 * 11/1991 Petersen ..... 52/742.14
5,088,259 * 2/1992 Myers ..... 52/410
5,440,845 * 8/1995 Tadros et al. ..... 52/309.12
5,540,022 * 7/1996 Morris ..... 52/309.8
5,571,596 * 11/1996 Johnson ..... 428/143
5,600,929 * 2/1997 Morris ..... 52/309.8
5,787,668 * 8/1998 Carkner et al. ..... 52/408
5,884,446 * 3/1999 Hageman ..... 52/408
5,979,133 * 11/1999 Funkhouser ..... 52/408

* cited by examiner

*Primary Examiner*—Christopher T. Kent
*Assistant Examiner*—Jennifer I. Thissell
(74) *Attorney, Agent, or Firm*—Cantor Colburn LLP

(57) ABSTRACT

A roofing system incorporating lightweight concrete. The system includes a deck and an insulation board. Lightweight concrete is placed between the deck and the insulation board. The deck includes upper and lower flutes and the insulation board has a plurality of channels formed therein. The lower flutes and channels form ribs in the concrete layer that strengthen the roofing system. The concrete layer may be attached to the deck by a series of protrusions in the deck that extend into the concrete. Alternatively, the concrete layer may float above the deck to prevent cracking. A release agent may be used to prevent the concrete layer from adhering to the deck.

27 Claims, 4 Drawing Sheets

SCRIM REINFORCED LIGHTWEIGHT CONCRETE ROOF SYSTEM

BACKGROUND OF THE INVENTION

1. Field of the Invention

The invention relates generally to roof systems and in particular to a roof system having a roof deck and a lightweight concrete poured over the roof deck.

2. Prior Art

FIG. 1 is a cross-sectional view of a conventional roofing system. This roofing system is described in U.S. Pat. No. 4,888,930, which is incorporated herein by reference. In FIG. 1, a roof deck 103 is attached to purlins 102 through fasteners 104. An insulation board 108 is attached to the deck 103 through fasteners 109, 110. A membrane 107 is placed over the top of the insulation board 108 to seal the roof. As shown in FIG. 2, the deck 103 maybe sealed by applying a caulk 112 at the deck joints. By sealing the deck 103, wind uplift forces WF are applied to the deck 103, and not the insulation board 108. The deck 103 can be rigidly fastened to the purlins 102 and thus withstand the uplift wind forces.

It is also known in the art to incorporate concrete into a roofing system in order to add stability to the roof. The concrete is placed between the insulation board and the roof deck. Holes are formed in the insulation board and when pressure is applied to the top of the insulation board, the concrete is forced up through the holes. Thus, the concrete provides a stable roof system. When uplift wind force is applied to the deck, the deck flexes causing the concrete to become detached from the deck and crack. This results in roof failure. There is a perceived need in the art for a concrete roof system that is resistant to uplift wind forces.

SUMMARY OF THE INVENTION

The above-discussed and other drawbacks and deficiencies of the prior art are overcome or alleviated by the concrete roof system of the invention. In the present invention, the concrete is either affixed to the roof deck or allowed to float above the roof deck when uplift force is present. Both alternatives reduce cracking of the lightweight concrete. The lightweight concrete may be affixed to the roof deck by providing undercuts in the deck material that hold the concrete to the deck and prevent flexing and cracking. Alternatively, the concrete can float above deck when the deck flexes. The concrete moves away from the deck when uplift forces are present and returns to contact the deck when the uplift force has subsided.

BRIEF DESCRIPTION OF THE DRAWINGS

Referring now to the drawings wherein like elements are numbered alike in the several FIGURES.

DETAILED DESCRIPTION OF THE INVENTION

Figure 3A:
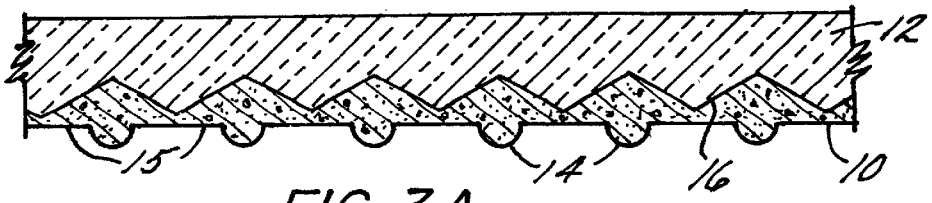
FIGS. 3A–3C are cross-sectional views of the roof deck and the insulation board.
Figure 3B:
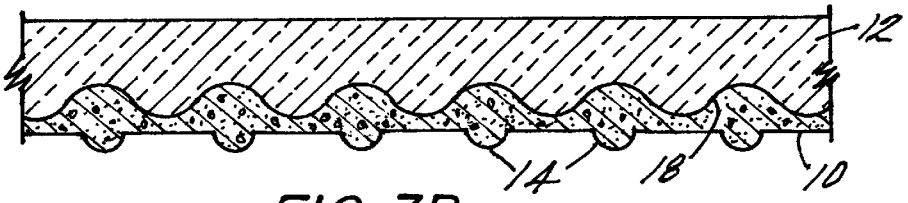
Figure 3C:
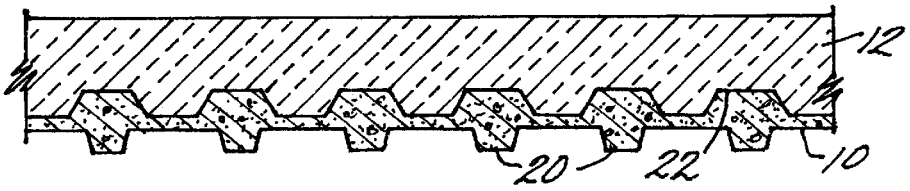

FIGS. 3A–3C are cross-sectional views of a roof deck 10 and an insulation board 12. The roof deck 10 may be made by overlapping corrugated panels made from metal or a concrete tectum composite. Alternatively, the roof deck 10 may be poured in place monolithic. The insulation board 12 may be a polystyrene material. As shown in FIG. 3A, the roof deck 10 is corrugated and includes a plurality of high flutes 15 and low flutes 14. The low flutes 14 in FIG. 3A are C-shaped. Formed in the insulation board 12, above each low flute 14, is a channel 16. The channel 16 in FIG. 3A has a triangular cross section. The lightweight concrete is placed between the insulation board 12 and the deck 10 to strengthen the roof assembly. By including channels 16 in the insulation board 12, the cured concrete includes a plurality of ribs defined by the channels 16 and the lower flutes 14 that strengthen the concrete form. The strength of the concrete will additionally strengthen the deck 10 against bowing movement and wind uplift pressures. Accordingly, it is less likely that the concrete will become detached from the deck 10 and subsequently crack. FIG. 3B shows an alternative channel 18 which has curved cross section. FIG. 3C shows another alternative channel 22 having a trapezoidal cross section and a lower flute 20 formed in the deck 10 having a trapezoidal cross section.

Figure 4:
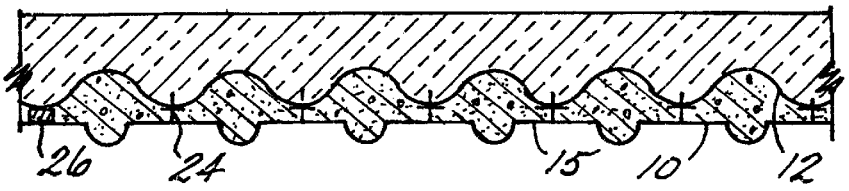
FIG. 4 is a cross-sectional view of the roof deck and insulation board.

FIG. 4 is a cross-sectional view of the insulation board 12 positioned above the deck 10. A nail and disk 24 is placed in the deck 10 so that the bottom of the insulation board 12 is positioned approximately ½ above the upper flute 15 of the deck 10. The lightweight concrete is then pumped into the space between the insulation board 12 and the deck 10. A block 26 may also be placed between the deck 10 and the insulation board 12 to prevent the movement of the concrete beyond a desired area.

Figure 5A:
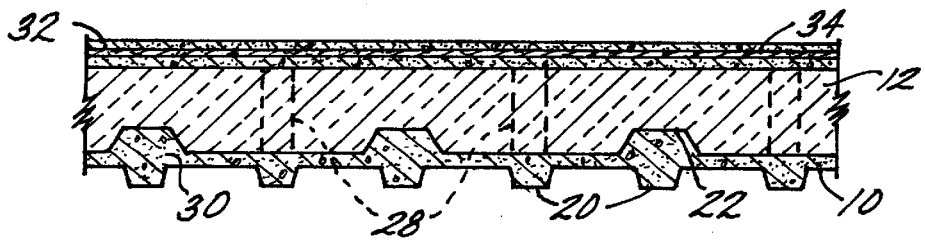
FIG. 5A is a cross-sectional view of the roof system including lightweight concrete.
Figure 5B:
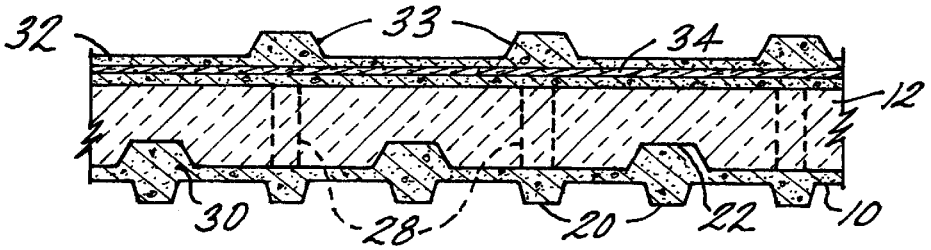
FIG. 5B is a cross-sectional view of an alternative top surface of the roof system including lightweight concrete.

FIG. 5 is a cross-sectional view of the roofing system including the lightweight concrete. Holes 28 are formed in the insulation board 12. Once concrete 30 is placed in the area between the deck 10 and the insulation board 12, pressure is applied to the top of insulation board 12. This causes the concrete 30 to be forced up through holes 28 to the top surface of the insulation board 12. Additional concrete may be poured over the top of the insulation board 12 to form a top concrete layer 32. The top concrete layer 32 may include a reinforcement structure 34 in the form of an elastic or polymeric mesh. Preferably, the mesh (scrim) is comprised of polyester or fiberglass and preferably includes a coating to inhibit deterioration from the highly alkaline compounds inherent in concrete. Mesh material that may be employed in the invention is Bond coat polyester or JPStevens fiberglass open mesh sheets both of which are commercially available from a variety of sources common and known to the industry. The elastic or polymeric mesh is fastened to the side edges of the insulation board 12 and is embedded (floated) in the top concrete layer 32. An additional benefit of the polymeric material is that it is light in weight. Therefore, the mesh "floats" near or at the top surface of the concrete. This has several advantages: the mesh holds water in the concrete to provide for a better cure of the concrete, provides a more aesthetically pleasing finish due to mitigating effects on bumps or lumps, and, importantly, the location of the mesh near the top surface of the concrete endows the concrete with greater resistance to fracture. Benefits as set forth can also be obtained if scrim is laid over partially cured concrete and an additional layer of concrete is poured thereover. As shown in FIG. 5B, additional ribs 33 may be formed in the top concrete layer 32 to provide additional rigidity. The ribs 33 may be either parallel or perpendicular to the ribs formed by channel 22 in the insulation board 12. The channels 22 formed in the insulation board 12 create ribs in the concrete 30 and enhance the strength of the deck 10 thereby reducing the likelihood that the deck 10 will flex causing the concrete 30 to become detached from the deck 10 and crack.

Figure 1:
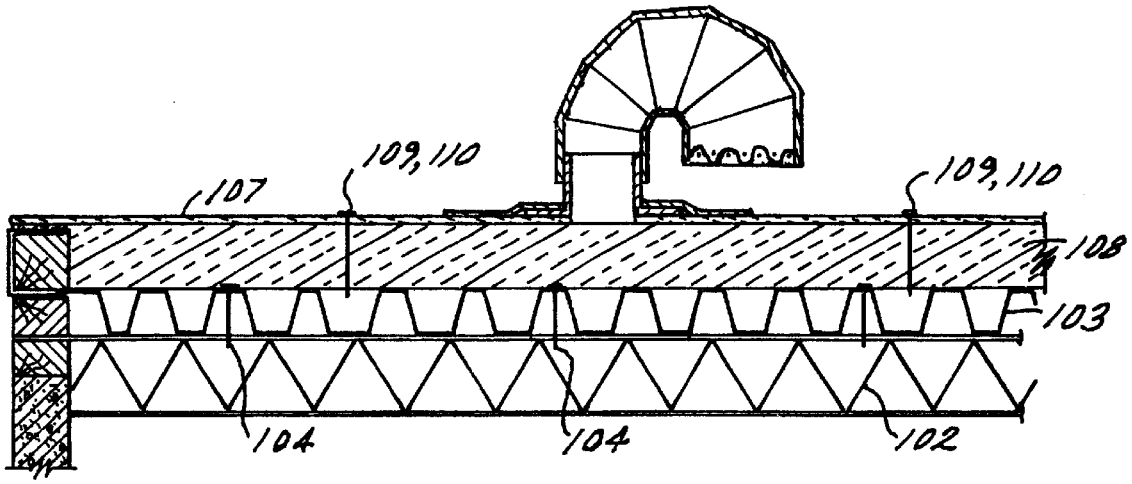
FIG. 1 (PRIOR ART)
FIG. 1 is a cross-sectional view of a conventional roofing system.
Figure 2:
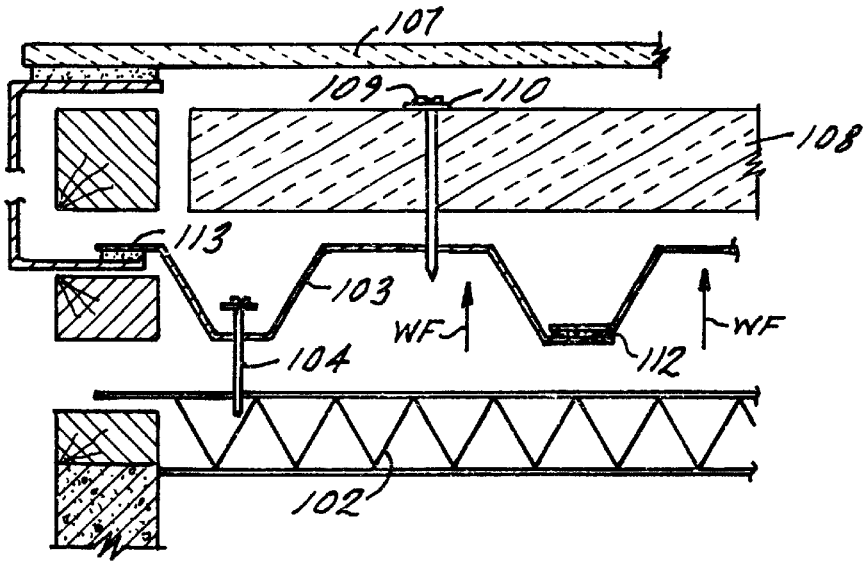
FIG. 2 (PRIOR ART)
FIG. 2 is an enlarged view of a portion of the conventional roof system of FIG. 1.

The combination of the deck 10 and the lightweight concrete assembly comprising the insulation board, bottom concrete layer 30 and top concrete layer 32 is fastened with mechanical fasteners between roof girder or joists with so that the roof would naturally bow between girders. A roof membrane, similar to membrane 107 in FIG. 1, is then laid loose or adhesively attached to the mechanical fasteners connecting the roof system to the girders or joists.

Figure 6:
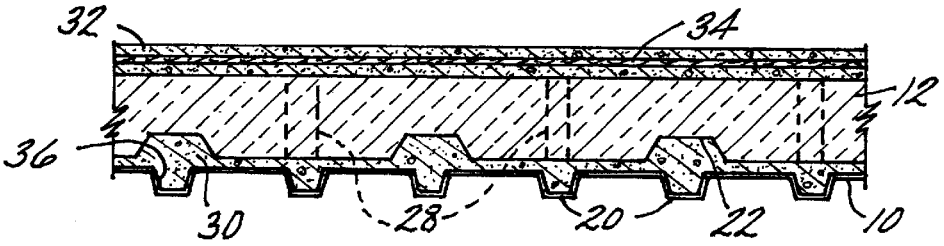
FIG. 6 is a cross-sectional view of a roof system having a sealed roof deck.

The deck 10 may be air sealed in a variety of ways. The deck 10 may be made from individual panels as shown in FIG. 1. These panels overlap at their ends and a caulk 112 is placed between the overlapping ends to seal the deck. Alternatively, as shown in FIG. 6, an air impermeable film 36 may be placed over the deck 10 to create an air sealed deck.

Figure 7:
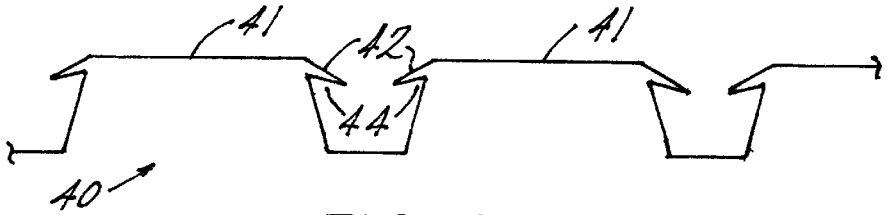
FIG. 7 is a cross-sectional view of an alternative roof deck.

As mentioned previously, the concrete may be attached to the deck to create an even stronger structure and to prevent the concrete from becoming detached from the deck. FIG. 7 shows a deck structure that prevents concrete from becoming detached from the deck. The deck 40 is similar to deck 10 described above except that the upper flute 41 includes a protrusion 42 extending into the area defined by the lower flute to create a recess 44 in the lower flute. When the concrete is poured over the deck 40, the recess 44 is filled with liquid concrete. When the concrete hardens, the protrusion 42 prevents the concrete from becoming detached from the deck 40. It is understood that other formations in the deck 10 may be used to affix the concrete layer 30 to the deck 10. This creates a solid deck and reduces the likelihood that the deck will flex or that the concrete will become detached from the deck and cause the concrete to crack.

Figure 8:
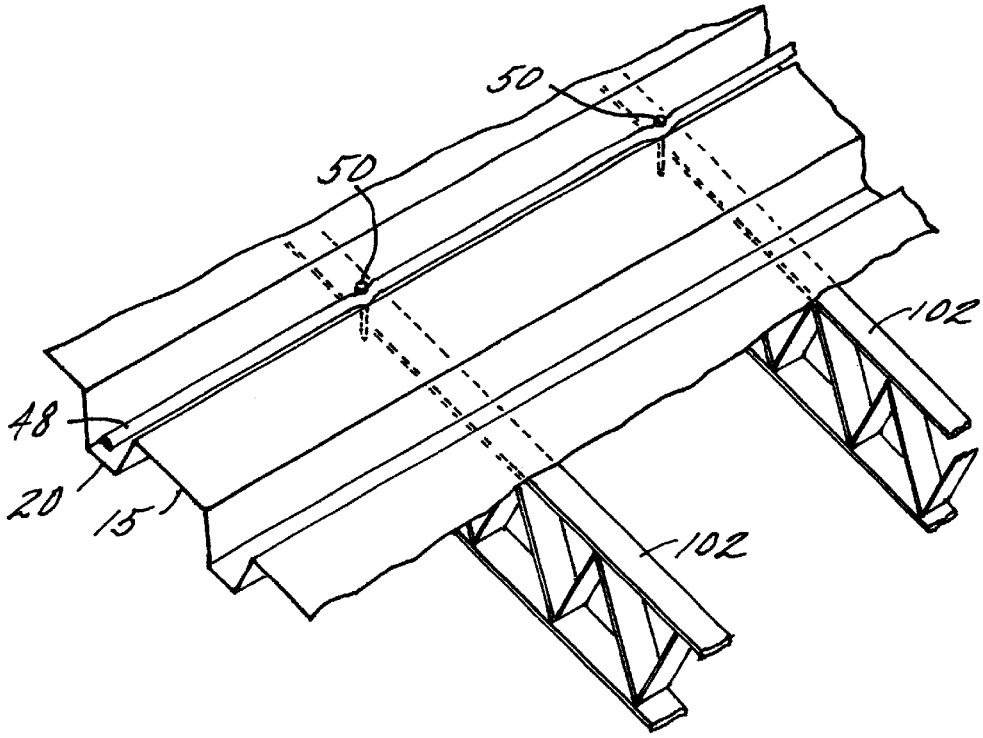
FIG. 8 perspective cut-away view of a roof system including cables placed in the roof deck.
Figure 9:
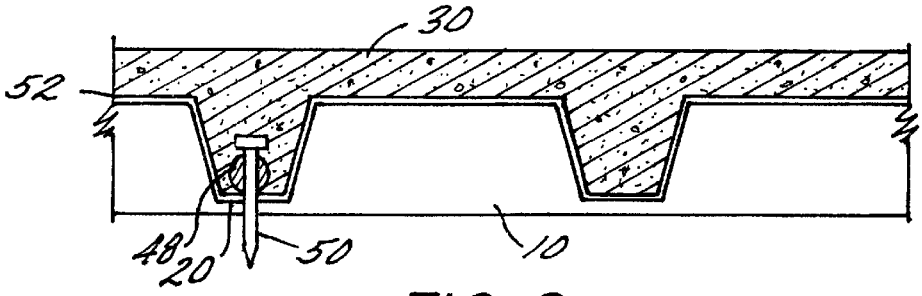
FIG. 9 cross-sectional view of the cable surrounded by concrete.

As mentioned above, the concrete may alternatively float above the deck. As the deck bends or flexes, the concrete can pull away from the deck and prevent stress on the concrete. FIG. 8 is a perspective cutaway view of a system for allowing the concrete to float relative to the deck. In FIG. 8, a lower flute 20 includes a cable 48. The cable 48 is attached to the roof system by fastener 50 that attaches the cable 48 to the purlins 102. As shown in FIG. 9, when the concrete 30 is poured over the deck 10, the concrete 30 flows around cable 48 and cable 48 becomes embedded in the hardened concrete 30. The ribs formed opposite the lower flute are not shown for ease of illustration. In the embodiment shown in FIGS. 8 and 9, the deck is not air sealed, so uplift wind forces are applied to the deck 10 and the concrete layer 30. The concrete 30 may pull away from the deck 10 when the deck flexes thereby preventing the concrete 30 from cracking. The cable 48 prevents the concrete 30 from moving too far from the deck 10. When the uplift wind force has subsided, the concrete 30 comes back into contact with the deck 10. A release agent 52, such as an oil or a thin membrane having a low coefficient of friction, may be placed over the deck 10 to prevent the concrete 30 from adhering to the deck 10 and allowing the concrete 30 to freely float above the deck 10.

Figure 10:
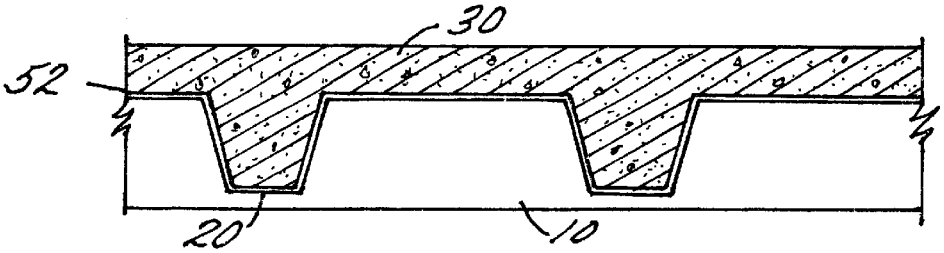
FIG. 10 is a cross-sectional view of an alternative roof system.

If the deck 10 is sealed, then the uplift wind force is applied to the deck 10 and does not directly contact the concrete 30. As shown in FIG. 10, the cable 48 is not needed to keep the concrete 30 proximate to the deck 10. The uplift wind force will be applied to the deck 10. If the deck 10 flexes or bends, the concrete 30 will rise above the deck 10 preventing stress and cracking of the concrete 30.

While preferred embodiments have been shown and described, various modifications and substitutions may be made thereto without departing from the spirit and scope of the invention. Accordingly, it is to be understood that the present invention has been described by way of illustration and not limitation.

What is claimed is:

1. A lightweight concrete roofing system comprising:

a roof deck, said deck comprising a plurality of upper flutes and lower flutes disposed therein;

a structure configured to support said roof deck;

a lightweight continuous concrete layer having a plurality of ribs formed therein disposed on said roof deck, said lightweight concrete layer being screeded to a desired finished slope;

a coated fiberglass open mesh cloth embedded within said lightweight concrete layer;

an insulation board positioned over said concrete layer, said insulation board comprising a plurality of channels therein, said ribs of said roof deck being defined by said lower flutes of said roof deck and said channels of said insulation board.

2. The roofing system of claim 1, wherein said insulation board has a top surface, said top surface being covered with a top concrete layer.

3. The roofing system of claim 2, wherein said top concrete layer comprises a reinforcement structure embedded in said top concrete layer.

4. The roofing system of claim 3, wherein said reinforcement structure is a coated fiberglass open mesh cloth.

5. The roofing system of claim 3, wherein said reinforcement structure is an open mesh cloth fabricated from a polymeric material.

6. The roofing system of claim 3, wherein said reinforcement structure is an open mesh cloth fabricated from an elastic material.

7. The roofing system of claim 2 further comprising a waterproofing membrane positioned above said top concrete layer.

8. The roofing system of claim 1, wherein said deck is formed from a plurality of overlapping concrete tectum panels.

9. The roofing system of claim 1, wherein said deck is a poured monolithic deck.

10. The roofing system of claim 3, wherein said reinforcement structure is an open mesh cloth fabricated from a fiberglass material.

11. The roofing system of claim 7 wherein said waterproofing membrane comprises a member loosely laid over said top concrete layer and sealed along a perimeter thereof and sealed at any penetrations thereto, and wherein said waterproofing membrane is held against said top concrete layer by a pressure differential across a profile of said waterproofing membrane.

12. A roofing deck comprising:

a plurality of upper flutes and lower flutes;

a protrusion extending from at least one of said upper flutes into a space defined by at least one of said lower flutes to form a recess for receiving concrete and attaching the concrete layer to said deck.

13. A roofing system comprising:

a deck;

a lightweight concrete layer movably positioned on a top side of said deck; and a cable having a first end and a second end, said first end being attached to said top side of said deck and said second end being attached to said lightweight concrete layer.

14. The roofing system of claim 13 wherein said deck is air permeable.

15. The roofing system of claim 14 wherein said deck comprises a plurality of upper flutes and lower flutes, and wherein said cable is positioned in said lower flute, said cable connecting said deck with said lightweight concrete layer.

16. The roofing system of claim 14 wherein said deck is positioned above purlins, said roofing system further comprising a fastener for connecting said cable to at least one purlin.

17. The roofing system of claim 15 wherein said deck is positioned above purlins, said roofing system further comprising a fastener for connecting said cable to at least one purlin.

18. The roofing system of claim 13 wherein said deck is sealed.

19. The roofing system of claim 13 further comprising a release agent between said concrete layer and said deck, said release agent preventing said concrete layer from adhering to said deck.

20. The roofing system of claim 19 wherein said release agent is an oil.

21. The roofing system of claim 19 wherein said release agent is a sheet of material having a low coefficient of friction.

22. The roofing system of claim 4 wherein said roof deck comprises a plurality of panels, said panels being permeable by air.

23. A roof deck comprising:

a corrugated metal material having tabs extending from a surface of said material, said tabs being contiguously formed with said surface of said material and extending into an area defined by a lower flute to create a recess in said lower flute thereby providing an anchoring point for hardened concrete.

24. A lightweight concrete roofing system comprising:

a roof deck said deck comprising a plurality of upper flutes and lower flutes disposed therein, said deck being formed from a plurality of overlapping metal panels, said overlapping metal panels being configured to form joints therebetween;

a structure configured to support said roof deck, a lightweight continuous concrete layer having a plurality of ribs formed therein disposed on said roof deck, said lightweight concrete layer being screeded to a desired finished slope;

at least one fin protruding from a surface of said roof deck to increase adhesive properties of said lightweight concrete layers a coated fiberglass open mesh cloth embedded within said lightweight concrete layer;

an insulation board positioned over said concrete layer, said insulation board comprising a plurality of channels therein, said ribs of said roof deck being defined by said lower flutes of said roof deck and said channels of said insulation board.

25. The roofing system of claim 24 wherein said joints are sufficiently sealed with a caulk thereby preventing the flow of air through said joints.

26. The roofing system of claim 25 wherein said caulk is a rubber-based caulk.

27. The roofing system of claim 25 wherein said joints are sealed with a membrane cover strip.

* * * * *